US006598753B2

(12) United States Patent
Ming

(10) Patent No.: US 6,598,753 B2
(45) Date of Patent: Jul. 29, 2003

(54) FOLDABLE UMBRELLA STAND

(76) Inventor: Tseng Yi Ming, No. 92-18, 18 Lin, Puu-Shin Tusan, Da-Yuan Village, Tao-Yuan Hsien (TW)

( * ) Notice: Subject to any disclaimer, the term of this patent is extended or adjusted under 35 U.S.C. 154(b) by 0 days.

(21) Appl. No.: 09/975,159

(22) Filed: Oct. 12, 2001

(65) Prior Publication Data

US 2003/0070997 A1 Apr. 17, 2003

(51) Int. Cl.[7] ..... A47G 25/12

(52) U.S. Cl. ..... 211/62; 211/104; 211/132.1; 211/150; 211/195

(58) Field of Search ..... 211/62, 64, 63, 211/104, 131.1, 132.1, 144, 149, 150, 195, 198, 200, 201

(56) References Cited

U.S. PATENT DOCUMENTS 253,081 A * 1/1882 McKenzie ..... 211/104
710,790 A * 10/1902 Magerhans ..... 211/62
3,093,247 A * 6/1963 Erickson ..... 211/149
3,834,548 A * 9/1974 Cliffton et al. ..... 211/196
6,123,207 A * 9/2000 Mast ..... 211/149
6,349,962 B1 * 2/2002 Johanson ..... 280/651

* cited by examiner

*Primary Examiner*—Bruce A. Lev
*Assistant Examiner*—Erica B Harris
(74) *Attorney, Agent, or Firm*—Troxell Law Office PLLC

(57) ABSTRACT

A foldable umbrella stand having two spaced apart upright posts with at least one grid frame and at least one water collecting tray pivotally connected to upper and lower ends of the upright posts. Connecting rods are provided on the lateral sides of the grid frames and the water collecting trays to movably connect them together. The umbrella stand thereby can be stretched and positioned for placing therein umbrellas, and can be folded into a flat form with a small volume for storage and transportation.

4 Claims, 6 Drawing Sheets

FOLDABLE UMBRELLA STAND

BACKGROUND OF THE INVENTION

1. Field of the invention

The present invention is related to an umbrella stand, and especially to such an umbrella stand able to be folded into a flat one with small volume when not in use.

2. Description of the Prior Art

An umbrella not only can shelter rain, but also can shade sunshine, when in a rainy day or a sunny day; it is general that people take umbrellas outdoors. However, umbrellas are used in abnormal weather, they are folded and stored in appropriate places indoors when not in use.

For convenience of storage, a house or a store generally prepares an umbrella stand for temporary insertion and placing of umbrellas. Umbrella stands used nowadays are mostly fixed; they occupy quite many spaces that can be useful otherwise when not in use. Not only common users have such a trouble, but also manufacturers of umbrella stands require larger packing volume for transportation after the umbrella stands are made by that the umbrella stands occupy larger spaces. Besides, sellers feel inconvenient in displaying and warehousing the umbrella stands.

SUMMARY OF THE INVENTION

The object of the present invention is to provide a foldable umbrella stand that is provided with two mutually opposite upright posts, the upper and lower ends of these upright posts are provided respectively with grid frames and water collecting trays. The grid frames and water collecting trays are provided on every lateral side respectively thereof with at least one connecting rod, and are rotatably connected respectively on the inner corners thereof with the inner surfaces of the upright posts. Thereby, when the umbrella stand is not in use, the grid frames and water collecting trays can be folded into a flat form with small volume taking advantage of the in connecting points.

In the preferred embodiment of the present invention just mentioned, the grid frames and water collecting trays used can be only one set provided on one side only of the two upright posts; alternatively, they can be two sets provided on both sides of the two upright posts.

In the preferred embodiment of the present invention, the water collecting trays or corresponding frames for them can be provided on the bottoms thereof with positioning links, in order that when the umbrella stand is stretched, they can be firmly positioned by means of the positioning links.

The present invention will be apparent in its novelty and features after reading the detailed description of the preferred embodiment thereof in reference to the accompanying drawings.

DETAILED DESCRIPTION OF THE PREFERRED EMBODIMENT

Figure 1:
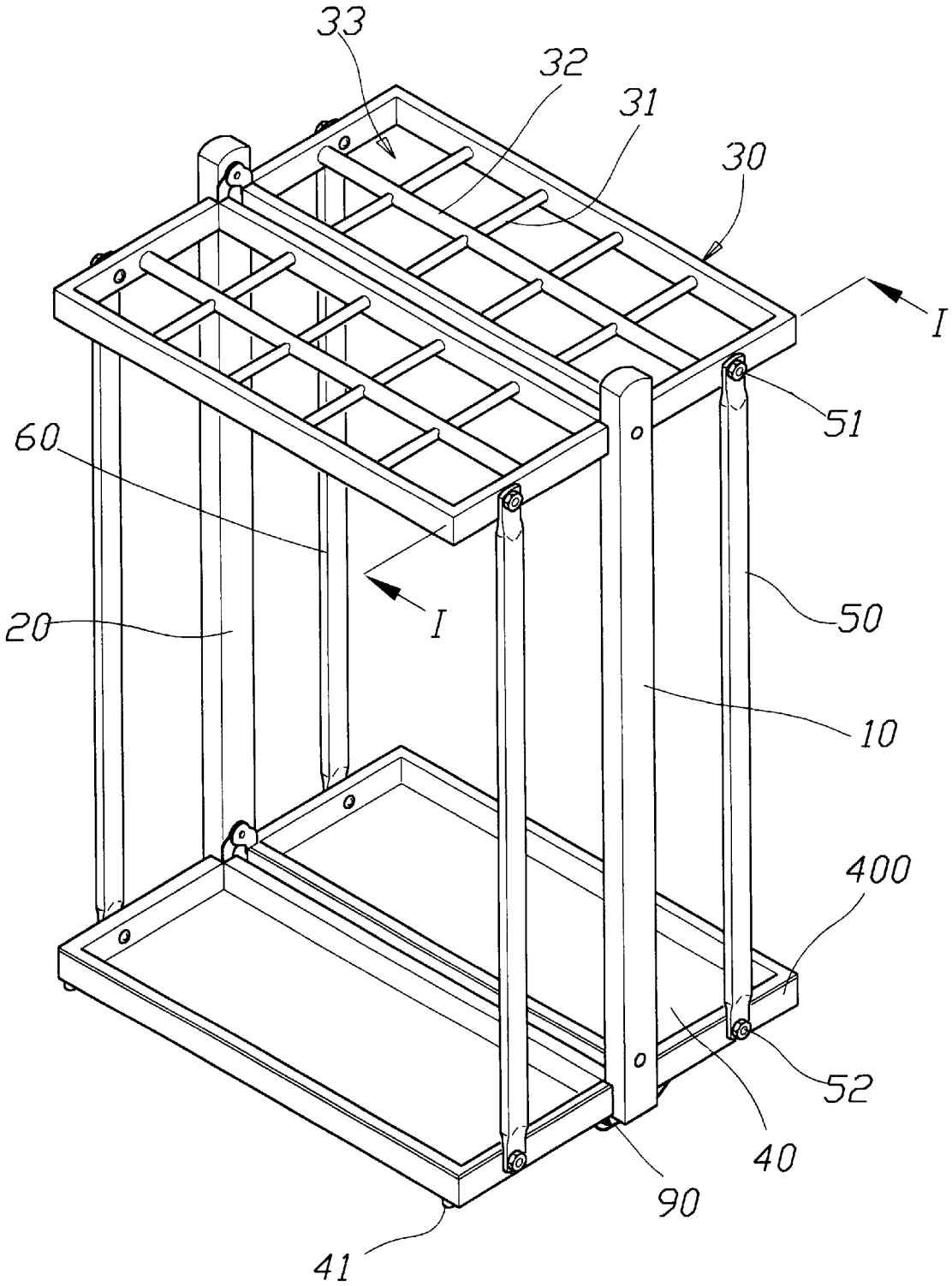
FIG. 1 is a perspective view showing a preferred embodiment of the present invention.
Figure 2:
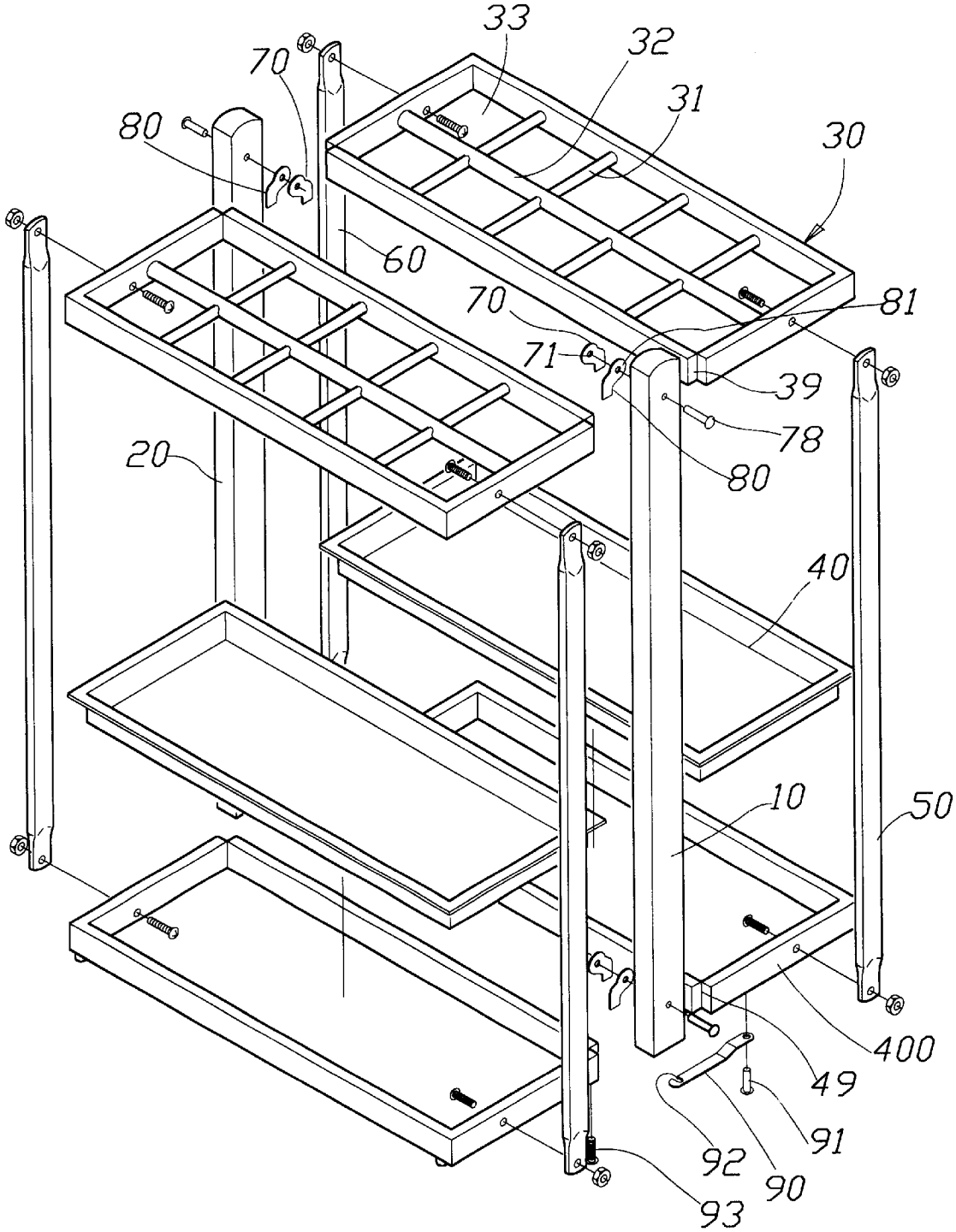
FIG. 2 is an exploded view of the elements of FIG. 1.

Referring to FIGS. 1 and 2, the present invention is provided with two mutually opposite upright posts 10, 20 with a length slightly smaller than that of a common umbrella. In the preferred embodiment shown, the upper and lower ends of these upright posts 10, 20 are provided on the two sides thereof with two sets of grid frames 30 and water collecting trays 40. Taking one set thereof as an example, a grid frame 30 in opposition vertically to a water collecting tray 40 is a frame with a plurality of transverse rods 31 and a longitudinal rod 32 forming a plurality of umbrella inserting holes 33. The water collecting tray 40 is a tray with an area in corresponding with that of the grid frame 30 for collecting rain drops. A plurality of corner ground connecting feet 41 are provided on the bottom of the water collecting the water collecting trays 40 are assembled each on a corresponding frame 400.

The grid frames 30 and the water collecting trays 40 are connected by means of mutually opposite connecting rods 50 and 60 on the lateral edges thereof to the upright posts 10, 20. The connecting rods 50 and 60 are movably bolt connected on the upper and lower ends 51, 52 thereof with the grid frames 30 and the water collecting trays 40.

Figure 3:
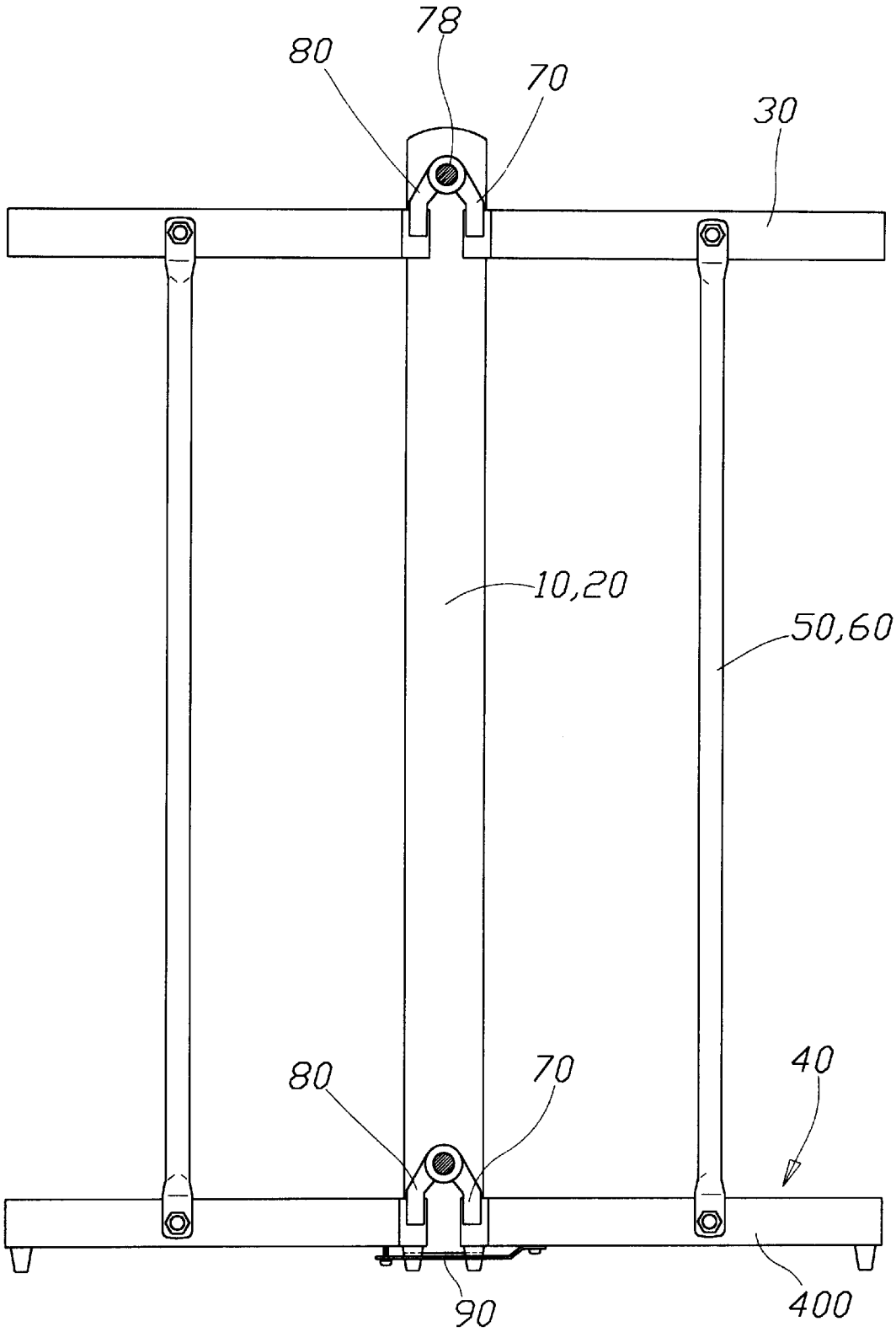
FIG. 3 is a side view taken in the direction of arrows I—I in FIG. 1.

Referring simultaneously to FIGS. 1–3, the connecting areas of the inner corners of the grid frames 30 and the water collecting trays 40 with the inner surfaces of the upright posts 10, 20 are provided with articular sheets 70, 80 for movable connecting. In the preferred embodiment shown, the connecting areas of the inner corners of the grid frames 30 and the water collecting trays 40 are provided respectively with notches 39 and 49 for welding thereto correspondingly one end of an articular sheet 70 (80), while the other end of every articular sheet 70, 80 is provided respectively with a hole 71 or 81 for insertion of a pin 78 from the outside of the upright post 10 or 20 correspondingly to movably connect the aforesaid other end of every articular sheet 70, 80.

Figure 4:
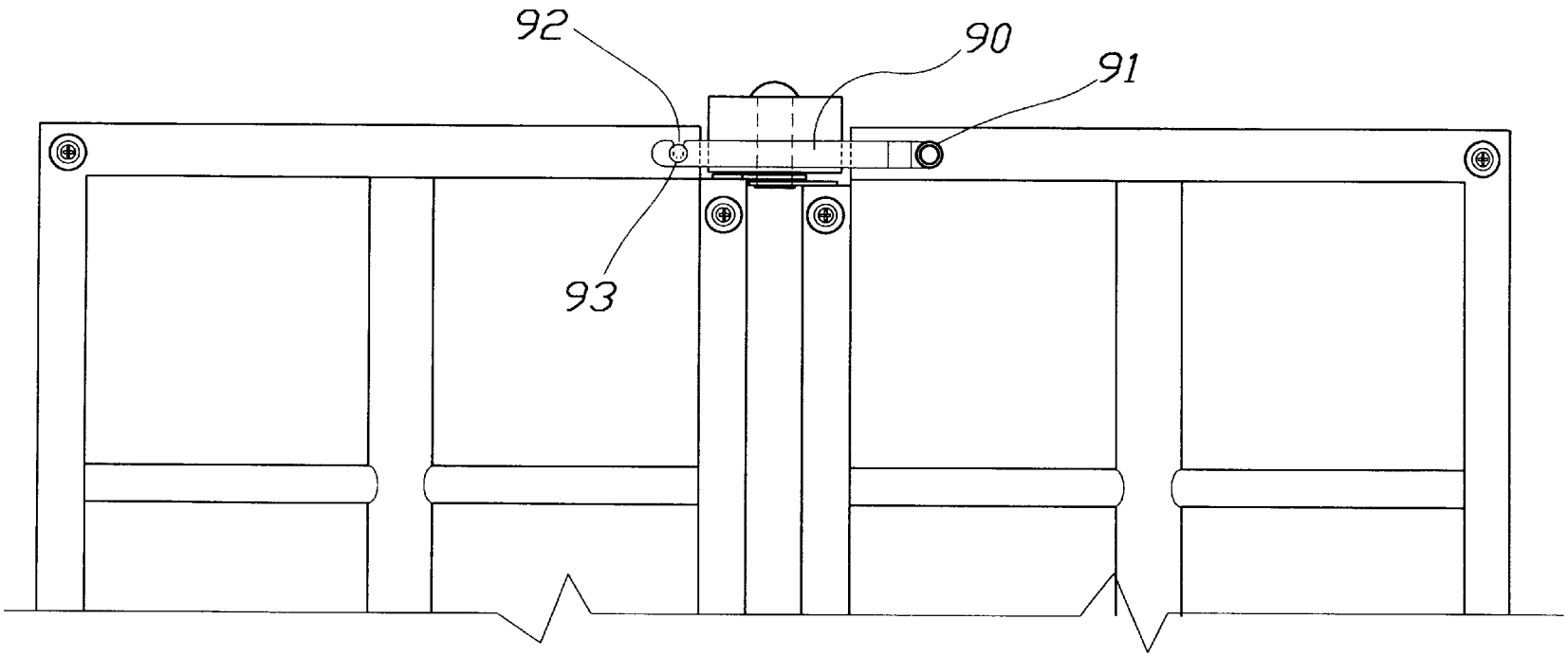
FIG. 4 is a partial bottom view taken from FIG. 3.

In order to increase the positioning ability of the umbrella stand when it is stretched, one of the water collecting trays 40 can be provided on the bottom thereof, and most preferably on the bottom of its corresponding frame 400, with positioning links 90. The positioning links 90 are pin connected by means of pins 91, and the other ends thereof each is provided with a hole 92, so that when the umbrella stand is stretched, it is stretched by rotation taking the pins 91 as axes, then the holes 92 are connected by bolts 93 on the bottom of the other of the water collecting trays 40 to connect the latter (referring to FIG. 4).

Figure 5:
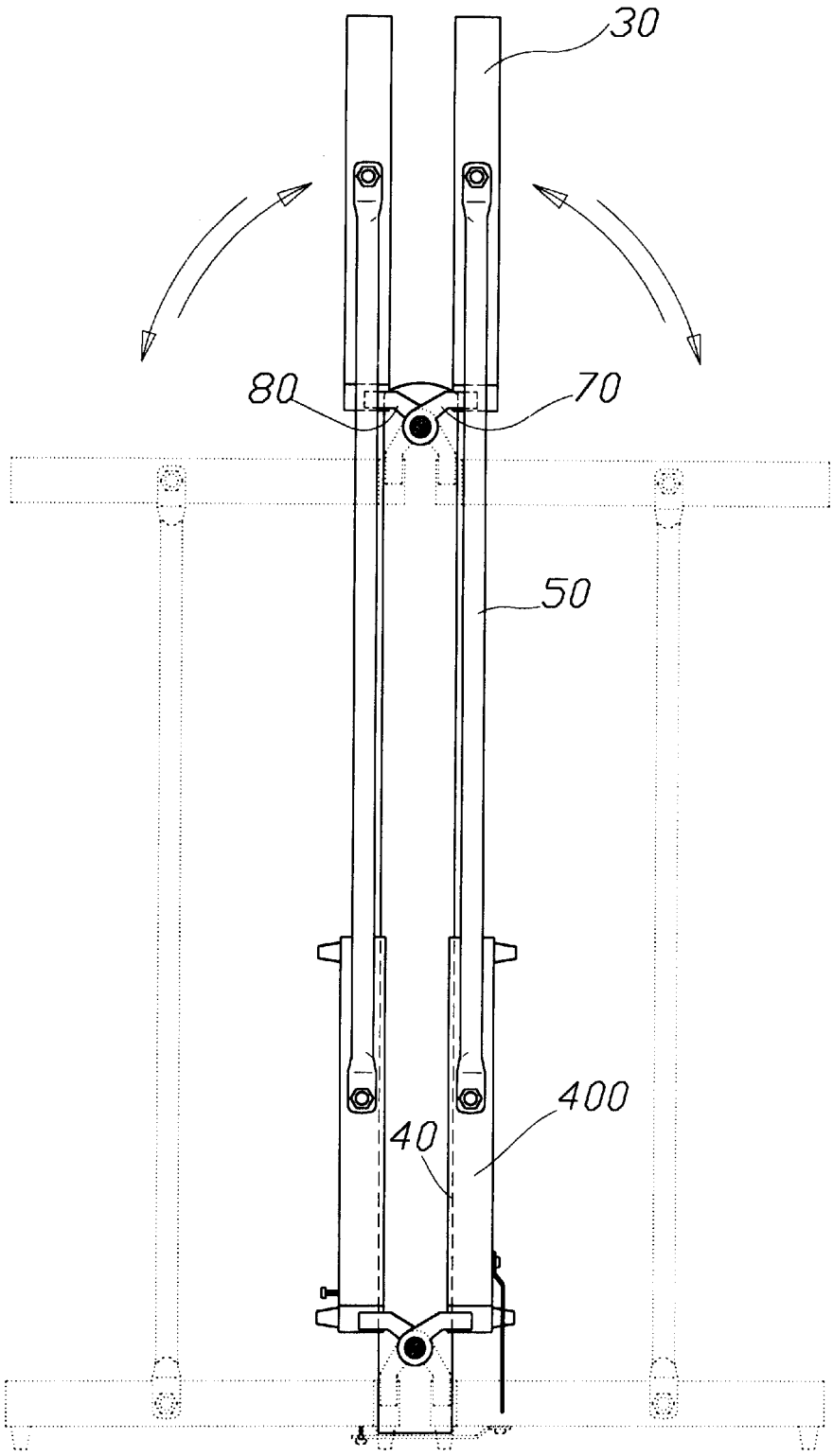
FIG. 5 is a schematic view showing the folding motion and the folding state of the embodiment in FIG. 3.

When the umbrella stand is not in use, it is folded about the movable connecting points 71, 81 and 78 of the particular sheets 70, 80 as shown in FIG. 5, toward the upright posts 10, 20 into a flat one with small volume. Contrarily, when in use, it is stretched to the state shown in FIG. 1.

Figure 6:
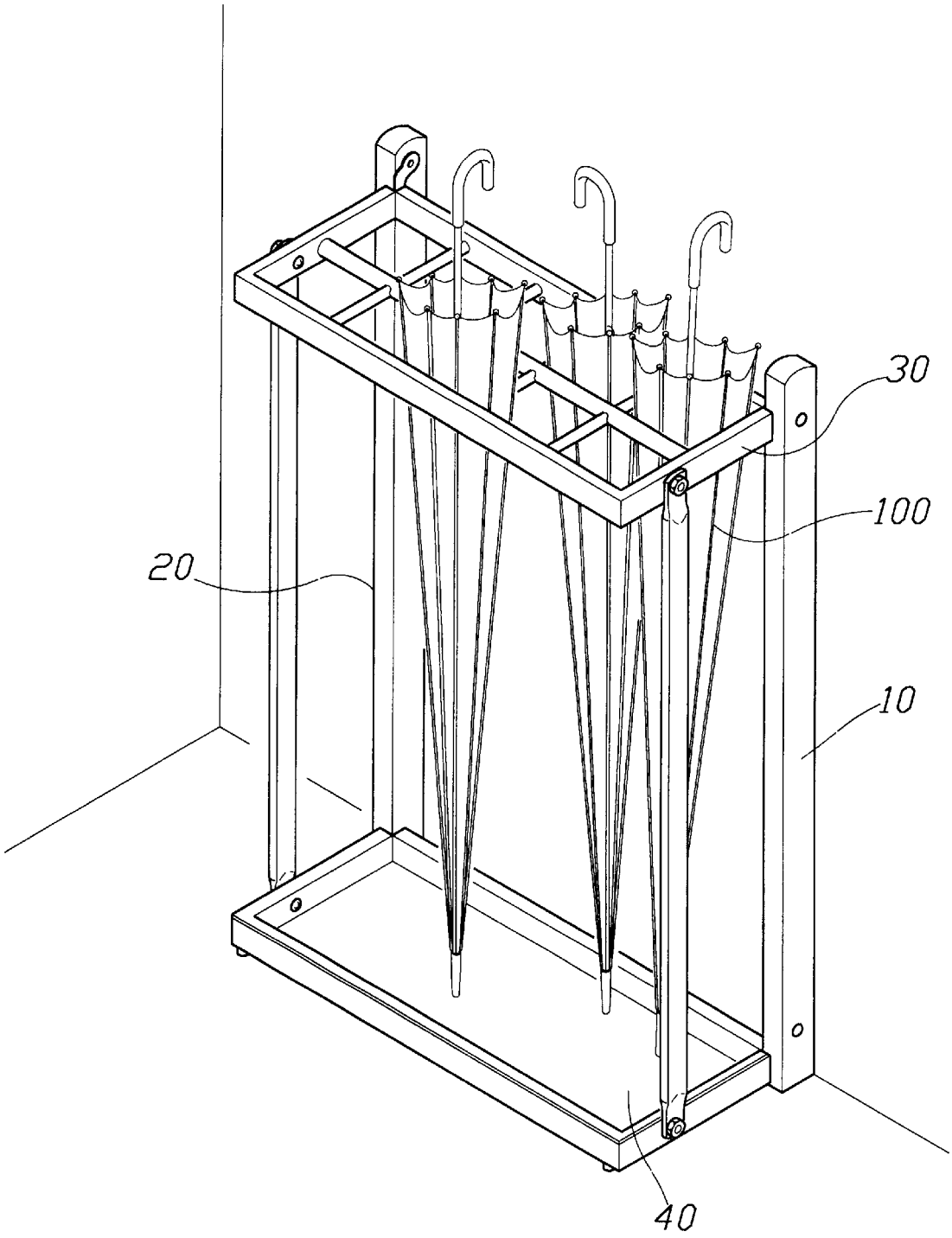
FIG. 6 is a perspective view showing another preferred embodiment of the present invention and the state of placing umbrellas therein.

In the preferred embodiment shown in FIG. 6, the umbrella stand has only one set of a grid frame and a water collecting tray. The grid frame 30 and the water collecting tray 40 on one side of the upright posts 10, 20 can be folded and stretched in the same way as stated above, and umbrellas 100 can be inserted to stand therein.

The present invention thereby can have a fixed umbrella stand folded into a flat one with small volume when the umbrella stand is not in use. The user or the manufacturer or both can have it folded out for placing umbrellas therein or up for transportation; such an umbrella stand is really convenient and practical.

Having thus described my invention, which is convenient and practical, what I claim as new and desire to be secured by Letters Patent of the United States are:

1. A foldable umbrella stand comprising:

a) two spaced apart upright posts;

b) at least one grid frame, each including a longitudinal rod and a plurality of transverse rods forming a plurality of umbrella inserting holes, the at least one grid frame pivotally attached to upper portions of the upright posts so as to pivot about first pivot pins located above the at least one grid frame between extended and retracted positions;

c) at least one water collecting tray located directly below the at least one grid frame and pivotally attached to lower portions of the upright posts so as to pivot about second pivot pins located above the at least one water collecting tray and below the at least one grid frame between extended and retracted positions; and, d) connecting rods, each having an upper end pivotally attached to one side of the at least one grid frame, and a lower end pivotally attached to one side of the at least one water collecting tray such that the at least one grid frame and the at least one water collecting tray move synchronously between the extended and retracted positions.

2. The foldable umbrella stand of claim 1 further comprising two grid frames extending in opposite directions from the upright posts and two water collecting trays extending in opposite directions from the upright posts.

3. The foldable umbrella stand of claim 2 further comprising a latching mechanism acting on the two water collecting trays to releasably latch the two water collecting trays in the extended positions.

4. The foldable umbrella stand of claim 3 wherein the latching mechanism comprises:

a) a bolt member extending from a first of the two water collecting trays; and, b) a positioning link pivotally connected to a second of the two water collecting trays, the positioning link having a slot located such that, when the bolt member engages the slot, the water collecting trays are latched in the extended positions.

* * * * *